US006520370B2

(12) United States Patent
Nyman et al.

(10) Patent No.: US 6,520,370 B2
(45) Date of Patent: Feb. 18, 2003

(54) PRODUCT DISPENSING CLOSURE WITH LID SUPPORT

(75) Inventors: Henry H. Nyman, York, PA (US); Aleksey Zats, Fair Lawn, NJ (US); Alexander Tsvaygoft, East Brunswick, NJ (US)

(73) Assignee: Paradigm Packaging, Inc., Saddle Brook, NJ (US)

( * ) Notice: Subject to any disclaimer, the term of this patent is extended or adjusted under 35 U.S.C. 154(b) by 92 days.

(21) Appl. No.: 09/780,793

(22) Filed: Feb. 9, 2001

(65) Prior Publication Data

US 2002/0088813 A1 Jul. 11, 2002

Related U.S. Application Data

(60) Provisional application No. 60/261,034, filed on Jan. 11, 2001.

(51) Int. Cl.[7] ..... B65D 43/14

(52) U.S. Cl. ..... 220/832; 215/235; 222/498

(58) Field of Search ..... 220/832, 831, 220/834, 847; 215/235, 254; 222/517, 498

(56) References Cited

U.S. PATENT DOCUMENTS

| | | | | |
|---|---|---|---|---|
| 3,441,161 A | | 4/1969 | Van Baarn | 215/40 |
| 3,791,551 A | | 2/1974 | Madeira | 220/60 |
| 3,804,286 A | | 4/1974 | Watson et al. | 220/27 |
| 3,934,751 A | | 1/1976 | Green et al. | 220/306 |
| 4,010,875 A | | 3/1977 | Babiol | 222/517 |
| 4,130,220 A | | 12/1978 | McKirnan | 220/284 |
| 4,135,638 A | | 1/1979 | Wandl | 220/284 |
| 4,165,018 A | | 8/1979 | Giggard | 220/284 |
| 4,220,284 A | | 9/1980 | Wilson et al. | 215/235 |
| 4,244,495 A | | 1/1981 | Lorscheid et al. | 222/153 |
| 4,278,178 A | | 7/1981 | Geiser | 215/215 |
| 4,513,888 A | | 4/1985 | Curry | 222/153 |
| 4,625,898 A | | 12/1986 | Hazard | 222/517 |
| 4,711,360 A | | 12/1987 | Ullman | 222/235 |
| 4,971,220 A | * | 11/1990 | Kaufman et al. | 220/335 |
| 5,271,536 A | | 12/1993 | Wilson | 222/498 |
| 5,337,912 A | | 8/1994 | Jochem | 220/306 |
| 5,398,837 A | * | 3/1995 | Degrassi | 220/375 |
| 5,484,101 A | * | 1/1996 | Hedberg | 229/125.04 |
| 5,639,002 A | * | 6/1997 | Weitbrecht et al. | 224/539 |
| 5,788,107 A | | 8/1998 | Meyer et al. | 220/284 |
| 6,318,605 B1 | * | 11/2001 | Nyman et al. | 222/517 |

FOREIGN PATENT DOCUMENTS

| | | | | |
|---|---|---|---|---|
| GB | 2068913 | * | 8/1981 | 220/823 |

* cited by examiner

*Primary Examiner*—Stephen P. Garbe
*Assistant Examiner*—Lien Ngo
(74) *Attorney, Agent, or Firm*—Peter B. Sorell; Mark S. Leonardo; Brown Rudnick Berlack Israels LLP

(57) ABSTRACT

A closure adapted for use with a product dispensing container is provided. The closure includes a closing lid moveable between a first position and a second position relative to the product dispensing container. The closing lid has projections engageable with the product dispensing container to substantially fix the closing lid in the second position via continuous engagement therebetween. The closure may include a tamper indicating portion that includes a removable tearband. The closure can have a retention collar for securing the closure to the product dispensing container. A hinge may connect the retention collar with the closing lid. The hinge can elastically connect the retention collar to the closing lid such that the hinge resiliently biases the closing lid towards the first position. The projections may flexibly extend from the closing lid and are deflectable upon engagement with the product dispensing container. The product dispensing container can have an open end including a neck portion defining at least one bead disposed about at least a portion thereof. Beads may be disposed about a circumference of the neck portion and include a top bead and a middle bead, the projections being disposable between the top bead and the middle bead to substantially fix the closing lid in the second position. In the first position, the closing lid can form a substantial seal with the product dispensing container.

18 Claims, 5 Drawing Sheets

PRODUCT DISPENSING CLOSURE WITH LID SUPPORT

CROSS-REFERENCE TO RELATED APPLICATION

This patent application claims priority from U.S. Provisional Application Ser. No. 60/261,034, filed on Jan. 11, 2001, by Nyman et al., the entire contents of which are hereby incorporated herein by reference.

BACKGROUND

1. Technical Field

The present invention relates generally to the field of product dispensing apparatus, and more particularly, to product dispensing apparatus having closures with lid support.

2. Description of Related Art

Various types of product dispensing devices are known. These devices typically include a container and a closure, cap, etc., that provide containment and packaging of a product within the container. The container and/or closure can include a dispensing portion for dispensing of the product. Numerous types of closures are known that provide containment of the product. Typically, the closure portion is molded from plastic, however, a metal-based material may be used. The material used should be sufficiently resilient such that the closure can be press fit over a neck portion of the container. The closure may also be threaded onto the container. See, for example, U.S. Pat. No. 3,441,161, all of the contents of which are incorporated herein by reference.

Many products, such as, for example, creams and lotions, are packaged in product dispensing devices which have closures that include disengageable or removable sections that allow opening of the closure so that the product may be dispensed. See, for example, U.S. Pat. No. 3,441,161. These devices, however, can fail to preserve the integrity of the product after the disengageable portion is removed and the product is initially used.

Product dispensing devices may include tamper evident portions used to preserve the integrity of the product prior to first use. This maintains safety and quality of the product to the user. One type of a tamper-evident portion utilizes a hinged, tear-band closure. This type of closure is disadvantaged by the lid's tendency to drift to the down position when released after opening.

Attempts have been made to overcome this disadvantage by preventing movement of the lid towards the down position. U.S. Pat. No. 4,220,248 to Wilson et al. shows a container having upstanding posts that prevent downward movement of a lid. Although these types of devices may prevent downward movement, the lid is still freely moveable about the container. These closure designs can undesirably interfere with dispensing and/or operation of the device, etc. Further, containers such as those may require special tooling and cannot be easily and economically made thereby increasing the manufacturing cost of the product dispensing device.

Accordingly, a need exists for a product dispensing apparatus having a closure that advantageously provides a lid substantially fixed in the open position. Desirably, the product dispensing apparatus creates a fluid and/or gas tight interface to preserve the integrity of a product contained within the product dispensing apparatus.

It is, therefore, an object of the present disclosure to overcome the disadvantages of the prior art by providing a product dispensing apparatus that provides a closure having a lid substantially fixed in the open position. Desirably, the product dispensing apparatus includes tamper indicating structure to determine if the integrity of a product contained within the product dispensing apparatus has been compromised.

It is another object of the present disclosure to provide such a product dispensing apparatus having a closure that forms a substantial seal with a container to preserve the integrity of the product.

It is yet another object of the present disclosure to provide a product dispensing apparatus which is easily and efficiently manufactured and assembled.

Objects and advantages of the present disclosure, set forth in part herein and in part will be obvious therefrom, achieve the intended purposes, objects, and advantages through a new, useful and non-obvious configuration of component elements at a reasonable cost to manufacture, and by employing readily available materials. The various embodiments contemplated are gleaned from the present disclosure and are realized and attained by means of the instrumentalities and combinations pointed out in the appended claims.

SUMMARY

The present disclosure is directed to a product dispensing apparatus having a closure that advantageously provides a lid substantially fixed in the open position. One of the advantages of the present disclosure is avoidance of undesirable interference and operation during product dispensing. Desirably, the closure provides a tamper indicating structure to determine if the integrity of a product contained within the product dispensing apparatus has been compromised.

In one particular embodiment, in accordance with the present disclosure, a closure adapted for use with a product dispensing container is provided. The closure includes a closing lid moveable between a first position and a second position relative to the product dispensing container. The closing lid has projections engageable with the product dispensing container to substantially fix the closing lid in the second position via a continuous engagement between the closing lid and the product dispensing container. The projections of the closing lid may flexibly extend from the closing lid and deflect upon engagement with the product dispensing container. The closure can include a tamper indicating portion having a removable tear band.

The closure may include a retention collar for securing the closure to the product dispensing container. A hinge may elastically connect the retention collar to the closing lid such that the hinge resiliently biases the closing lid towards the first position.

In an alternate embodiment, the product dispensing container may have an open end including a neck portion which has at least one bead. The projections may engage the at least one bead of the product dispensing container. The neck portion of the product dispensing container may have at least two beads including a top bead and a middle bead disposed about a circumference of the neck portion. The projections are engageable with the product dispersing container between the top bead and the middle bead to substantially fix the closing lid in the second position. In the first position, the closing lid may form a substantial seal with the product dispensing container. The second position can include a plurality of orientations. In the second position, the closing lid may be adjustable in a plurality of orientations.

In another alternate embodiment, in accordance with the present disclosure, a product dispensing apparatus is provided. The product dispensing apparatus includes a container having an open end including a neck portion. The neck portion defines at least two beads. The product dispensing apparatus also includes a closure having a closing lid moveable between a first position and a second position. The closing lid has projections configured to engage at least one bead of the container. The closure further includes a retention collar which is mountable to the container and connectable to the closing lid such that the closing lid is biased towards the first position. In the first position, the closing lid substantially seals an opening of the open end, and in the second position, the projections continuously engage the container to substantially fix orientation of the closing lid.

The neck portion may define a circumference and the at least two beads may include a top retention bead, a middle retention bead, a lower retention bead and a transfer bead being disposed about the circumference of the neck portion. The projections of the closing lid may flexibly extend from the closing lid and are deflectable upon engagement with the middle retention bead. The projections are disposable between the top bead and the middle bead to substantially fix the closing lid in the second position. In the first position, the top retention bead may engage a bead formed on an inner surface of the closure to facilitate formation of the substantial seal. In the second position, the closing lid may be adjustable in a plurality of orientations.

In another alternate embodiment, the product dispensing apparatus includes a container with an open end defining an opening. The container includes a neck which has a top retention bead, a middle retention bead, a lower retention bead and a transfer bead. The top retention bead and the middle retention bead define a groove therebetween. The product dispensing apparatus also includes a closure having a closing lid moveable between a first position and a second position. The closing lid has flexible projections extending therefrom configured to deflect upon engagement with the middle retention bead of the container. The closure includes a retention collar mountable to the container and connectable to the closing lid via an elastic hinge such that the closing lid is resiliently biased towards the first position.

A tamper indicating portion is included, having a tear band which removably connects the closing lid and the retention collar to provide a first visual indication. The tamper indicating portion is removable to provide a second visual indication. In the first position, the closing lid portion substantially seals the opening of the open end of the container, and in the second position, the projections continuously engage the neck of the container and are configured for disposal within at least a portion of the groove to substantially fix orientation of the closing lid portion.

In yet another alternate embodiment, the closure includes a closing lid means moveable between a first position and a second position. A retention means mounts the closure to the product dispensing container. The retention means is flexibly connected to the closing lid means to resiliently bias the closing lid means towards the first position. The closure includes an engagement means for substantially fixing the closing lid means in the second position via continuous engagement between the closure and the product dispensing container.

BRIEF DESCRIPTION OF THE DRAWINGS

The objects and features of the present disclosure, which are believed to be novel, are set forth with particularity in the appended claims. The present disclosure, both as to its organization and manner of operation, together with further objectives and advantages, may best be understood by reference to the following description, taken in connection with the accompanying drawings, in which:

DETAILED DESCRIPTION OF THE EXEMPLARY EMBODIMENTS

Figure 1:
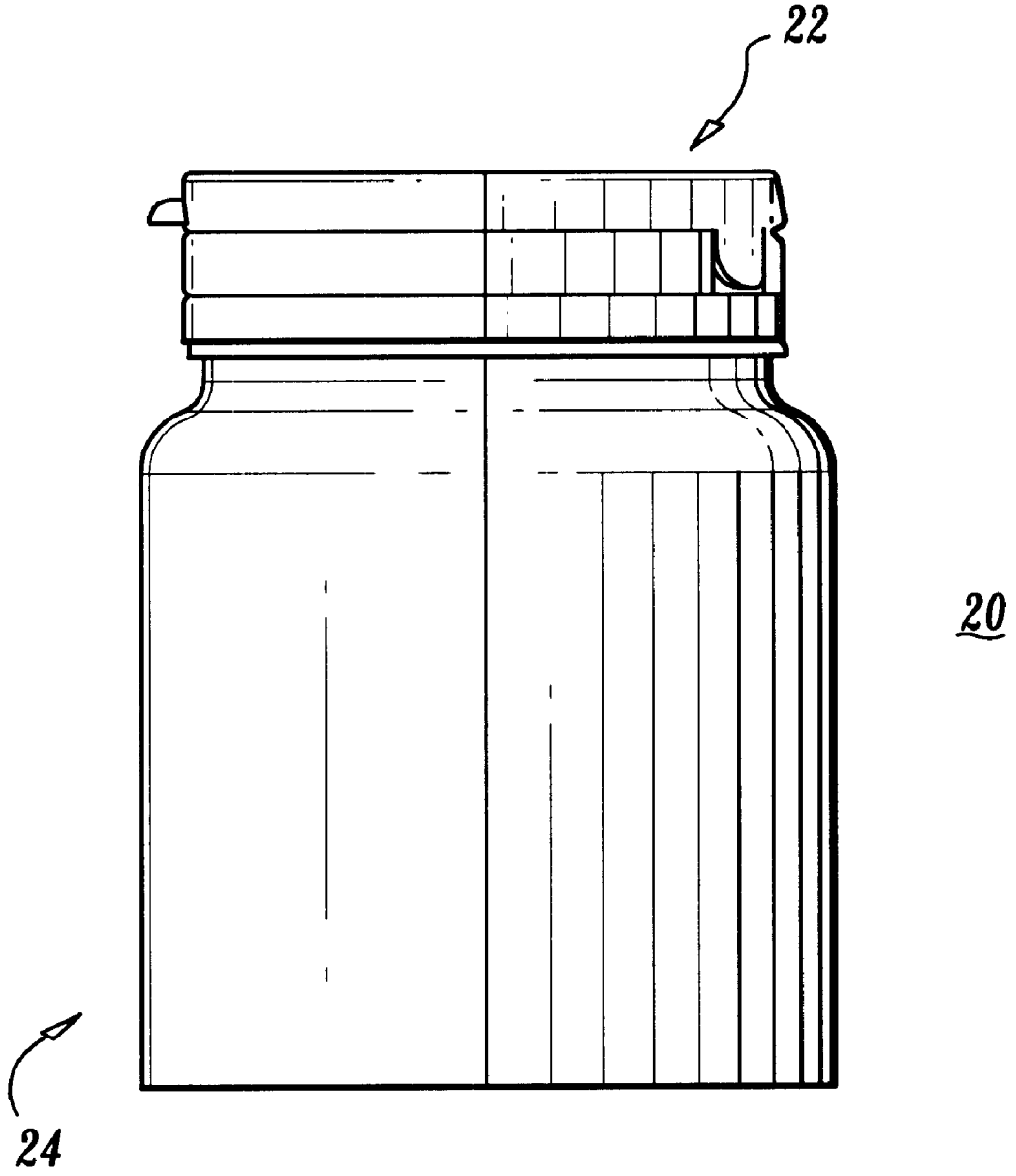
FIG. 1 is a side view of a product dispensing apparatus in accordance with one embodiment of the present disclosure.

The exemplary embodiments of the product dispensing apparatus disclosed herein are discussed in terms of product dispensers. It is envisioned, however, that the disclosure is applicable to a wide variety of product dispensers and vessel-type containers which dispense products contained therein. It is believed that the present disclosure finds application with various uses for the storing, dispensing, etc., of products, such as, foodstuffs, medicines, creams, lotions, liquids, etc.

In the discussion which follows, the term "container" refers, but is not limited to, molded plastic vessels having an open end through which a product is packaged. It is contemplated that subsequent to packaging and filling of a product, the open end may be sealed to close by, for example, heat sealing, pressure, capping, etc. It is important to note, however, that the present disclosure is readily applicable to containers and packaging vessels such as tubes, bottles, etc., that are provided in a pre-packaged condition containing products to be dispensed.

Reference will now be made in detail to the embodiments of the present disclosure that are illustrated in the accompanying figures. Turning now to the figures, wherein like components are designated by like reference numerals throughout the several views, attention is initially directed to FIG. 1. The product dispensing apparatus, such as, for example, a product dispenser, shown generally as 20, in accordance with one embodiment of the present disclosure is illustrated. Methods of assembly, manufacture and use for product dispenser 20 are also described.

Product dispenser 20 provides a design that maintains an open position during dispensing of a product (not shown). Product dispenser 20 advantageously includes a dispensing system that substantially fixes a portion of the product dispensing apparatus in the open position to facilitate effective dispensing of a product (not shown). Another advantage of the dispensing system of product dispenser 20 is tamper evidence structure that provides a visual indication, discussed below, that the integrity of product dispenser 20 and the product contained therein have not been compromised and/or tampered with.

Product dispenser 20 includes a closure 22 adapted for a use with a product dispensing container 24. Closure 22 cooperatively engages container 24 such that closure 22 substantially fixes closure 22 in a second position, such as, for example, an open position (FIGS. 11 and 12) via continuous engagement between portions of closure 22 and container 24, discussed below. This configuration prevents closure 22 from drifting to a substantially closed position when released. Furthermore, closure 22 is maintained in a fixed and open position to advantageously facilitate facile and reliable operation of product dispenser 20.

Figure 2:
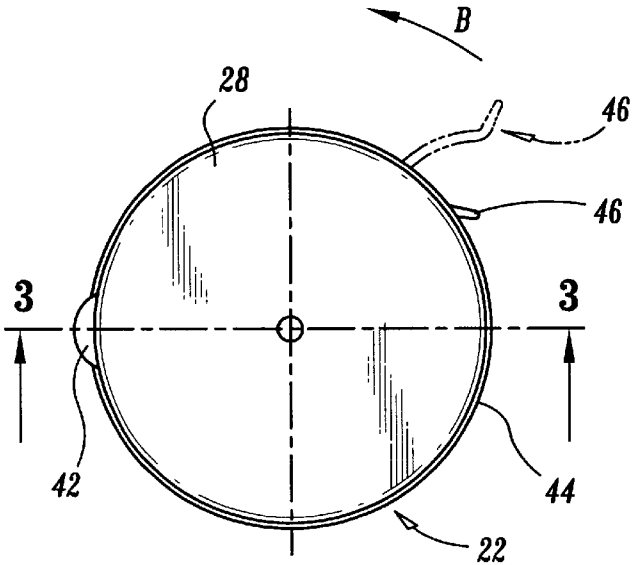
FIG. 2 is a top view of a closure of the product dispensing apparatus shown in FIG. 1, illustrating removal of a tamper indicating portion in phantom.

Referring to FIG. 2, closure 22 is substantially cylindrical and molded from suitable plastics. It is envisioned that closure 22 may be integrally assembled of its constituent components and may have various configurations, such as, for example, rectangular, etc. Closure 22 is fabricated from a semi-rigid material with sufficient flexibility for assembly with container 24 (FIG. 1). Closure 22 and container 24 are correspondingly molded for integral assembly therewith. One skilled in the art, however, will realize that other materials and fabrication methods suitable for assembly and manufacture, in accordance with the present disclosure, also would be appropriate.

Figure 3:
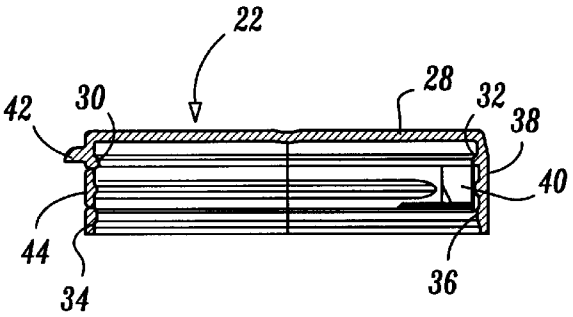
FIG. 3 is a cross-sectional view, in part elevation, of the closure shown in FIG. 1.

Closure 22 is mounted about an open end 26 (FIG. 11) of container 24 and has a closing lid 28 having a substantially flat configuration. It is envisioned that closing lid 28 may also be domed, etc. Referring to FIG. 3, closing lid 28 includes a top retention bead 30 formed on an inner surface 32 and about a circumference thereof. Top retention bead 30 is configured to facilitate a releasable sealing engagement of closing lid 28 with open end 26 of container 24 to preserve the integrity of a product contained within product dispenser 20, as will be discussed below. Inner surface 32 is sufficiently flexible such that retention bead 30 engages and is press-fit or snapped onto open end 26 of container 24 to form a seal with open end 26. It is contemplated that retention bead 30 may be disposed about the entire circumference of inner surface 32 or, alternatively, may be formed about only a portion of inner surface 32 or intermittently spaced.

Figure 9:
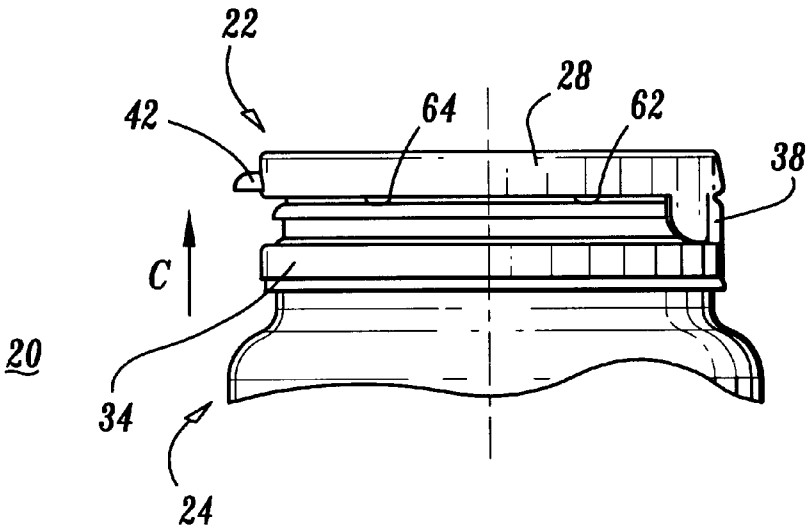
FIG. 9 is a side view of the product dispensing apparatus shown in FIG. 6, illustrating a second visual indication and the closing lid in a first position.

Upon engagement of retention bead 30 and open end 26 retention forces are created therebetween to maintain closing lid 28 in a first position, such as, for example, a closed position (FIG. 9). This feature of the present disclosure advantageously prevents contaminates from entering container 24 or product exiting therefrom. In an alternate embodiment, container 24 may have a closed end defining an orifice configured for receipt of an orifice plug of closing lid 28 to provide a releasable sealing engagement.

Figure 4:
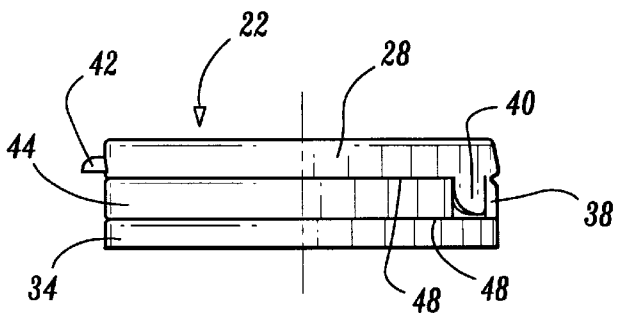
FIG. 4 is a side view of the closure shown in FIG. 1.

Referring to FIGS. 3 and 4, closure 22 includes a retention collar 34 configured for mounting about an outer surface of container 24 (FIG. 1). Retention collar 34 includes a lower retention bead 36 formed about the circumference of inner surface 32 of closure 22. Retention bead 36 facilitates mounting of closure 22 to container 24, as will be discussed below. It is contemplated that retention bead 36 may be disposed about the entire circumference of retention collar 34 or, alternatively, may be formed about only a portion of retention collar 34 or intermittently spaced.

Retention collar 34 is sufficiently flexible, such that upon assembly of closure 22 with container 24, discussed below, retention bead 36 engages and is press-fit or snapped to the outer surface of container 24 to facilitate mounting thereof.

Figure 5:
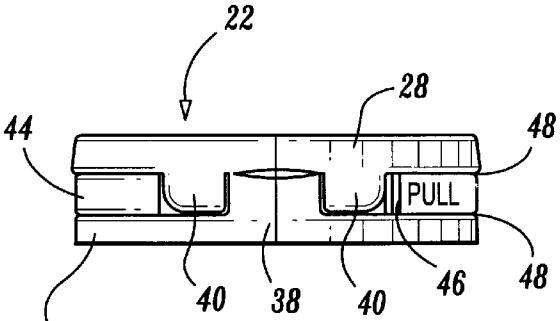
FIG. 5 is a rear view of the closure shown in FIG. 1.

Referring to FIG. 5, closure 22 includes a hinge member 38 that facilitates connection of closing lid 28 with retention collar 34. Hinge member 38 elastically connects closing lid 28 to retention collar 34, such that hinge member 38 resiliently biases closing lid 28 towards the closed position. Hinge member 38 is disposed diametrically from a thumb tab 42 (FIG. 4) of closing lid 28 to facilitate pivotal movement of closing lid 28 relative to container 24 (FIG. 1) during manipulation thereof via thumb tab 42.

Hinge member 38 is fabricated from a material with sufficient resilient characteristics to facilitate pivotal movement of closing lid 28 relative to retention collar 44. It is contemplated that hinge member 38 is monolithically formed with closure 22, has a reduced thickness for flexibility, or, alternatively, may be integrally assembled with closure 22 and fabricated from a suitable elastic material in accordance with the present disclosure.

Closing lid 28 is moveable between the closed position (FIGS. 9 and 10) and the open position (FIGS. 11 and 12) relative to product dispenser 20. Closing lid 28 has projections, such as, for example, support tabs 40 which are engageable with container 24 to substantially fix closing lid 28 in the open position via continuous engagement therebetween. Support tabs 40 project from closing lid 28 adjacent to hinge member 38. It is contemplated that only one support tab 40 or that multiple support tabs may be used. It is further contemplated that supports tabs 40 may be variously position about closing lid 28.

Support tabs 40 are monolithically formed with closing lid 28 and fabricated from a material with sufficient flexibility for deflection relative to container 24 to facilitate manipulation of closing lid 28 between the closed and the open positions. Support tabs 40 may be formed in various geometric configurations, such as, for example, rectangular, etc., and at variable lengths according to the particular container application and their corresponding strength requirements. Support tabs 40 engage and deflect about open end 26 (FIG. 8) of container 24 to substantially fix closing lid 28, in the open position, as will be discussed below.

A thumb tab 42 (FIG. 4) is formed with closing lid 28 to facilitate manipulation of closing lid 28. Thumb tab 42 is formed diametrically from hinge member 38 to facilitate pivotal movement of closing lid 28 about hinge member 38.

Closure 22 includes a tamper evident portion, such as, for example, a tear band 44 which is circumferentially disposed about closing lid 28 of closure 22. Tear band 44 removably connects closing lid 28 and retention collar 34. Tear band 44 is a circumferential strip, which is adapted to be removed by pulling a tab 46 of tear band 44 about the circumference of closure 22. Tear band 44 is connected to closing lid 28 and retention collar 34 by wall sections 48. Wall sections 48 are easily ruptured and broken away from closing lid 28 and retention collar 34 so that closing lid 28 can be manipulated to the open position, discussed below, and the product disposed within container 24 can be dispensed from product dispenser 20.

Tear band 44 is monolithically formed with closure 22. During fabrication, wall sections 48 are formed, such as, for example, by reducing the material thickness of closure 22 at wall sections 48 so that wall sections 48 may be easily ruptured and broken away from closure 22. It is contemplated that tear band 44 may be integrally assembled with closure 22 and subsequently attached by heat treating, etc. It is envisioned that wall sections 48 may be perforated in a subsequent manufacturing operation to facilitate easy rupture from closure 22. Tear band 44 may also be fabricated from other materials suitable for a product dispensing application. One skilled in the art, however, will realize that other materials and fabrication methods suitable for product dispensing manufacture in accordance with the present disclosure, will also be appropriate.

Product dispenser 20 advantageously includes the tamper evident portion to alert a consumer if product dispenser 20 has been opened or the product disposed within plastic container 24 has been tampered with. Tear band 44 removably connects closing lid 28 and retention collar 34 to provide a first visual indication. The first visual indication indicates to a consumer that the integrity of the product disposed within plastic container 24 has not been compromised. Tearband 44 is removable by having the consumer grasp tab 46 of tearband 44, discussed below, with a hand (not shown). The consumer then pulls tearband 44 about the circumference of closure 22, in the direction shown by arrow B (FIG. 2).

Removal of tearband 44 provides a second visual indication. The second visual indication indicates to the consumer that the integrity of the product disposed within plastic container 24 may have been compromised, i.e., the sealing engagement between closing lid 28 and opening 26 of container 24 has be interrupted and the product may have been dispensed from product dispenser 20 and/or contaminants may have entered container 24.

Figure 7:
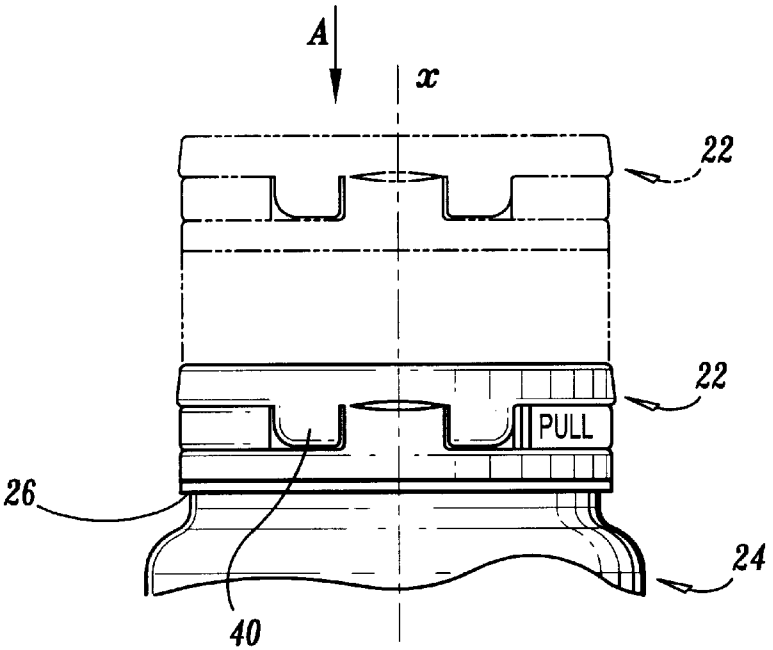
FIG. 7 is a rear view, in cut-away, of the product dispensing apparatus shown in FIG. 6, illustrating assembly of the product dispensing apparatus in phantom.
Figure 6:
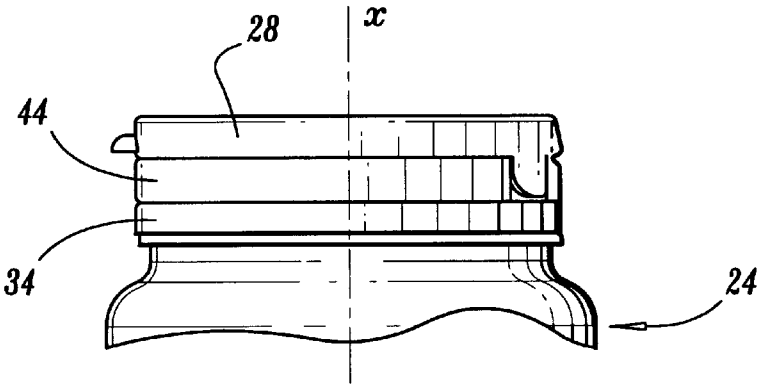
FIG. 6 is a side view, in cut-away, of the product dispensing apparatus shown in FIG. 1 illustrating a first visual indication.
Figure 8:
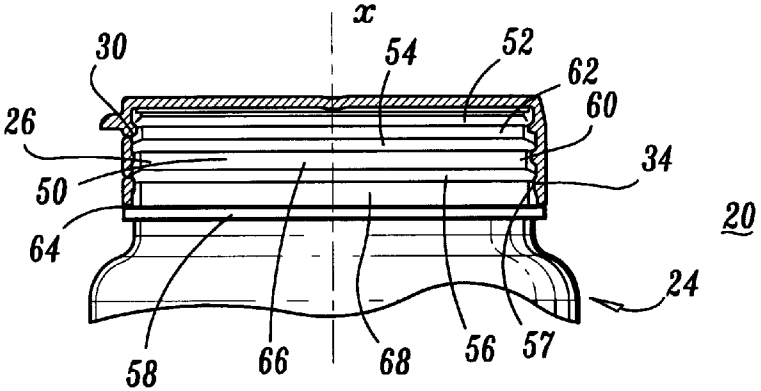
FIG. 8 is a side elevation view, in cut-away, of the product dispensing apparatus shown in FIG. 6 illustrating the closing lid in cross-section.

Referring to FIGS. 6–8, container 24 extends along a longitudinal axis x defined thereby. Alternatively, container 24 may not be elongated and may have an increased width along an access transverse to longitudinal axis x.

Container 24 is molded from suitable plastics appropriate for product dispensing applications. Container 24 is monolithically formed and has a substantially cylindrical configuration. It is contemplated that container 24 may be integrally assembled from multiple components and may have various configurations, such as, for example, rectangular, etc. Container 24 may, alternatively, be fabricated from rigid or semi-rigid materials such as, metal based materials or plastics which incorporate metal stiffeners to provide sufficient rigidity. One skilled in the art, however, will realize that other materials and fabrication methods suitable for assembly and manufacture, in accordance with the present disclosure also would be appropriate.

Referring specifically to FIG. 8, open end 26 of container 24 includes a neck portion 50. Neck portion 50 defines a top retention bead 52, a middle retention bead 54, a lower retention bead 56 and a transfer bead 58. Beads 52, 54, 56 and 58 are monolithically formed with open end 26 in a substantially parallel orientation to facilitate engagement and assembly with closure 22. It is envisioned that beads 52, 54, 56 and 58 may be variously oriented, such as, for example, slanted, offset, etc., according to the particular container application or may be integrally assembled with container 24.

Top retention bead 52 is formed in an outer surface 60 and about the circumference of open end 26. It is envisioned that retention bead 52 may be formed about the entire circumference of open end 26, or, alternatively, only a portion of outer surface 60, and variously disposed thereabout, or intermittently spaced. Retention bead 52 is configured to engage retention bead 30 of closing lid 28 to facilitate formation of the substantial seal between closing lid 28 and open end 26, and maintaining closing lid 28 in the closed position, as discussed herein. Retention bead 52 is substantially rigid such that retention bead 30 can be press-fit or snapped over retention bead 52, as discussed above.

Middle retention bead 54 is formed in outer surface 60 about the circumference of open end 26. It is envisioned that retention bead 54 may be formed about the entire circumference of open end 26, or, alternatively, only a portion of outer surface 60 and variously disposed thereabout, or intermittently spaced.

Middle retention bead 54 and top retention bead 52 define a groove 62 therebetween. It is contemplated that groove 62 may be variously configured and dimensioned according to the particular dispensing application. Support tabs 40 are disposable within groove 62 (FIGS. 9–12) to substantially fix closing lid 28 in the open position via the continuous engagement between support tabs 40 and container 24. In manipulating closing lid 28 from the closed position to the open position, support tabs 40 deflect over retention bead 54. In the open position, support tabs 40 are disposed between top retention bead 52 and middle retention bead 54. The flexibility of hinge member 38 (FIG. 5) creates elastic forces therein such that closing lid 28 is resiliently biased towards the closed position. Support tabs 40 are thereby caused to engage middle retention bead 54 and substantially fix closing lid 28 in the open position. The bias of closing lid 28, however, is insufficient to overcome the inward bias of support tabs 40 towards container 24 and urge them from groove 62 without further manipulation.

Retention bead 56 is formed in outer surface 60 about the circumference of open end 26. It is envisioned that retention bead 56 may be formed about the entire circumference of open end 26, or, alternatively, only a portion of outer surface 60 and variously disposed thereabout, or intermittently spaced.

Lower retention bead 56 is configured to engage retention collar 34 to facilitate mounting of closure 22 with container 24. A bead 57 formed about at least a portion of the circumference of retention collar 34 is press-fit over lower retention bead 56 during assembly, discussed below. Lower retention bead 56 and a transfer bead 58, discussed below, mount at least a portion of retention collar 34 therebetween for securement of the components of product dispenser 20. It is contemplated that retention collar 34 may be movably or fixedly disposed between lower retention bead 56 and transfer bead 58.

Transfer bead 58 is formed in outer surface 60 about the circumference of open end 26. It is envisioned that a transfer bead 58 may be formed about the entire circumference of open end 26, or, alternatively, only a portion of outer surface 60 and variously disposed thereabout, or intermittently spaced. Transfer bead 58 is configured to engage an end portion 64 of closure 22 and cooperate with lower retention bead 56, as discussed, to facilitate mounting of retention collar 34 with plastic container 24. Engagement of end portion 64 and transfer bead 58 provides a stable mounting and uniform engagement of the constituent parts of product dispenser 20. Retention collar 34 is mounted below transfer bead 58.

In an alternate embodiment, the open position of closing lid 28 includes a plurality of orientations. For example, upon disposal of support tabs 40 within groove 62, described above, closing lid 28 is in the open position in a first orientation. Alternatively, outer surface 60 of open end 26 defines a groove 66 between middle retention bead 54 and lower retention bead 56. Support tabs 40 are manipulated for disposal within groove 66, similar to that described above with regard to groove 62, and closing lid 28 is substantially fixed in the open position in a second orientation. Alternatively, outer surface 60 of open end 26 defines a groove 68 between lower retention bead 56 and transfer bead 58. Support tabs 40 are manipulated for disposal within groove 68, similar to that described above, and closing lid 28 is substantially fixed in the open position in a third orientation.

It is contemplated that closing lid 28 may be substantially fixed in any one orientation or in a plurality of orientations in the open position of closing lid 28, according to the particular container application and the requirements thereof. It is further contemplated that grooves 62, 66 and 68 may be variously configured and dimensioned according to the strength requirements of a particular container application for substantially fixing closing lid 28 in the open position.

Referring to FIG. 7, assembly of product dispenser 20 will be described. A product (not shown) is filled within container 24 through open end 26 or otherwise, as is known in the art. Closure 22 is manipulated into proper orientation for assembly with open end 26 of container 24. Closure 22 and container 24 are aligned along longitudinal axis x such that beads 30 and 57 of closure 22 can be press-fit over top retention bead 52 and lower retention bead 56, respectively, of container 24, similar to that described, for mounting the components of product dispenser 20. It is contemplated that tear band 44 may include a circumferential bead for mounting.

Upon proper alignment of closure 22 with container 24, a force A is applied in the direction of the arrow shown, to closure 22. Closure 22 engages and is press-fit with container 24, described above, thereby mounting the components of product dispenser 20. Upon mounting, closing lid 28 forms a substantial seal with and thereby substantially seals open end 26. The substantial seal includes a fluid and/or gas tight interface to preserve the integrity of product dispenser 20 and/or the products contained therein.

Operation of product dispenser 20 will now be described. Referring to FIG. 6, product dispenser 20 is grasped with a hand (not shown) of the consumer and manipulated for use. Tearband 44 connects closing lid 28 and retention collar 34 to provide a first visual indication, described above. This condition of tearband 44 provides a visual indication that the integrity of the sealing engagement formed between closing lid 28 and open end 26 has not been compromised.

Referring to FIG. 2, tab 46 of tearband 44 is grasped by the consumer and manipulated circumferentially about closure 22 for removal therefrom and partial separation of closing lid 28 and retention collar 34, as described above. Tab 46 is manipulated, in the direction shown by arrow B, causing wall sections 48 to rupture and break for removal of tearband 44 from closure 22, while leaving hinge member 38 intact.

Figure 10:
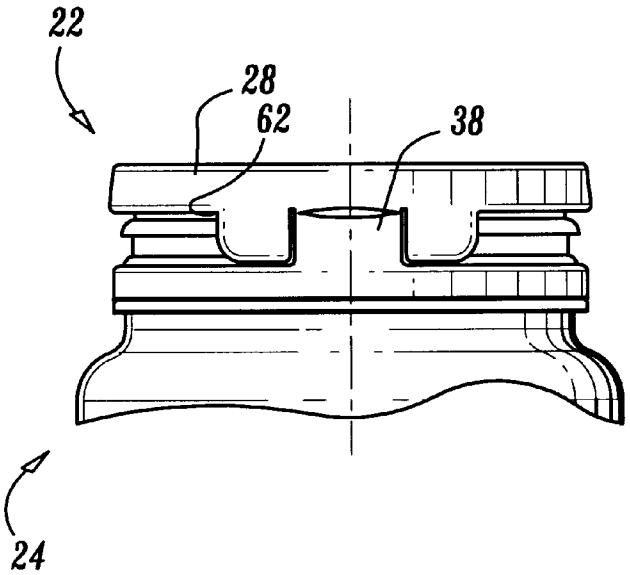
FIG. 10 is a rear view of the product dispensing apparatus shown in FIG. 9.

Referring to FIGS. 9 and 10, upon removal of tearband 44, a second visual indication is provided, as described above. This indication provides tamper evidence, indicating the possibility that the sealing engagement formed between closing lid 28 and open end 26 has been interrupted. Closing lid 28 and retention collar 34 are separated adjacent wall sections 48 where tearband 44 has been removed. The connection of closing lid 28 and retention collar 34 is maintained by hinge member 38 and closing lid 28 is in the closed position.

Figure 12:
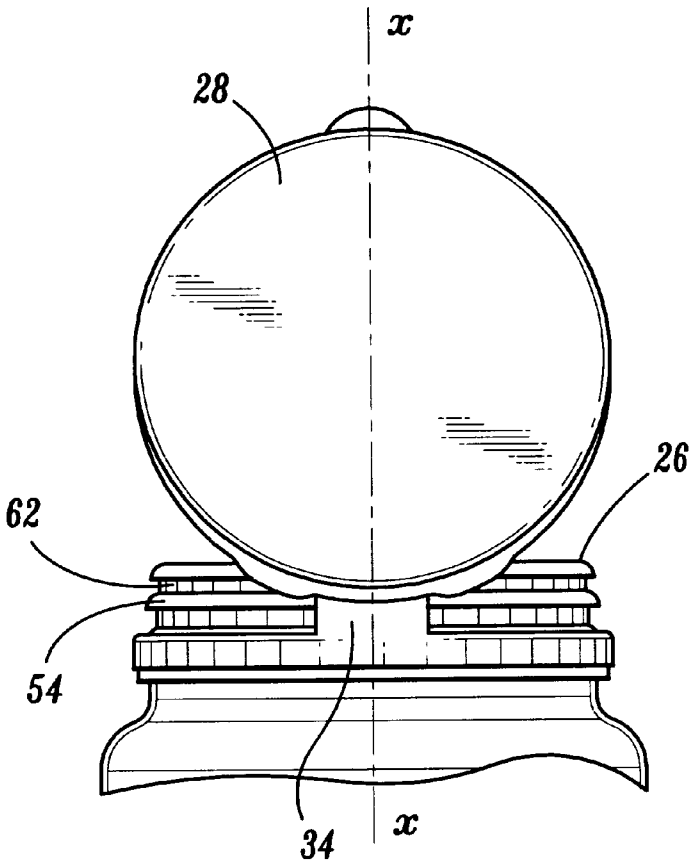
FIG. 12 is a rear view of the product dispensing apparatus shown in FIG. 11.
Figure 11:
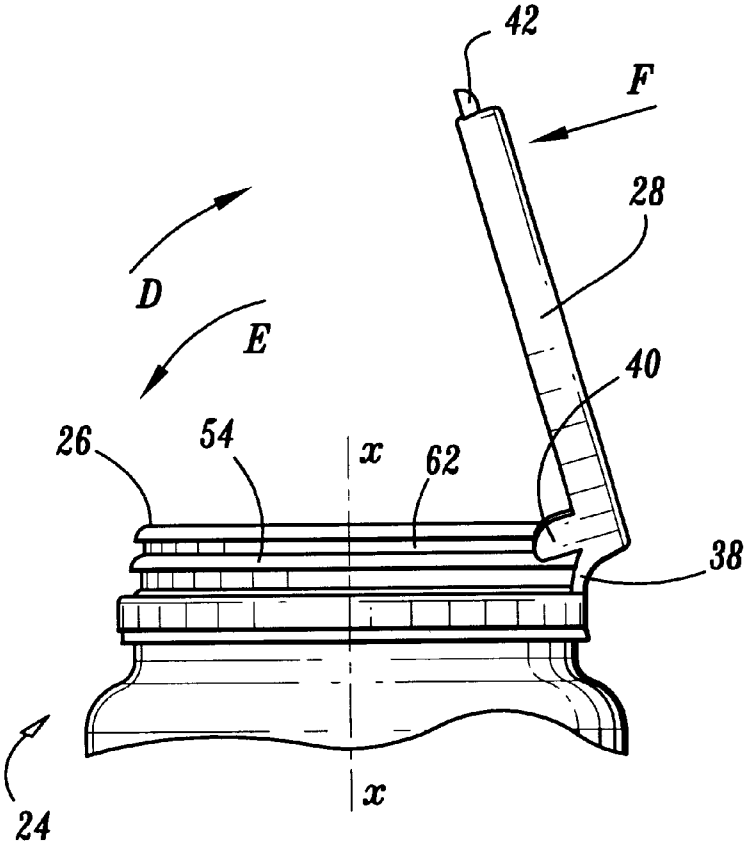
FIG. 11 is a side view of the product dispensing apparatus shown in FIG. 9, illustrating the closing lid in a second position.

Upon removal of tearband 44, closing lid 28 is movable between the closed position (FIGS. 9 and 10) and the open position (FIGS. 11 and 12). In the closed position, closing lid 28 and open end 26 maintain a sealing engagement therebetween. A force, in the direction shown by arrow C, is applied to the underside of tab 42 of closing lid 28. Tab 42 is formed in closing lid 28 generally opposite from hinge member 38, such that application of the force in the direction shown by arrow C to tab 42 causes closing lid 28 to pivot about hinge member 38. As the force is applied to tab 42, the retention forces between retention bead 30 of closure 22 and retention bead 52 of container 24 are overcome thereby interrupting the substantial seal between closing lid 28 and open end 26. It is contemplated that a snapping and/or popping sound is an audible signal to the consumer that the sealing engagement of closing lid 28 and open end 26 is interrupted and closing lid 28 is not in the closed position.

After the seal is interrupted, closing lid 28 is not in the closed position. Referring to FIGS. 11 and 12, closing lid 28 is manipulated to pivot about hinge member 38, in the direction shown by arrow D, towards the open position. Support tabs 40 are caused to engage and deflect over middle retention bead 54. Support tabs 40 become disposed within groove 62 to substantially fix closing lid 28 in the open position, as discussed above.

As closing lid 28 is manipulated in the direction shown by arrow D, hinge member 38 bows inwardly creating elastic forces which resiliently bias closing lid 28 towards the closed position, in the direction shown by arrow E. The resilient bias of closing lid 28 towards the closed position causes support tabs 40 to abut middle retention bead 54. The elastic forces of hinge member 38 which bias closing lid 28 towards the closed position, are not sufficient to displace support tabs 40 from groove 62 and deflect the tabs over middle retention bead 54. Closing lid 28 is thereby substantially fixed in the open position via continuous engagement of closure 22 and container 24. Alternatively, closing lid 28 may be substantially fixed in the open position in a plurality of orientations, as discussed above.

To return closing lid 28 to the closed position, a force in the direction shown by arrow F, is applied to tab 42 of closing lid 28. The force applied to tab 42 overcomes the engagement of support tabs 40 and middle retention bead 54, such that support tabs 40 deflect over and clear out of interference with middle retention bead 54. The resilient forces of hinge member 34 and continued manipulation, in the direction shown by arrow E, towards the closed position, causes bead 30 of closing lid 28 to engage and press-fit over top retention bead 52 of container 24 to create the substantial seal between closing lid 28 and open end 26 which includes the fluid and/or gas tight interface therebetween in the closed position. It is contemplated that closing lid 28 and container 24 may not create a fluid and/or gas tight interface.

It is envisioned that the substantial seal is formed when closure 22 and container 24 are fabricated from materials of dissimilar hardness.

It will be understood that various modifications may be made to the embodiments disclosed herein. Therefore, the above descriptions should not be construed as limiting, but merely as exemplification of the various embodiments. Those skilled in the art will envision other modifications within the scope and spirit of the appended claims.

What is claimed is:

1. A product dispensing apparatus comprising:

a container having an open end and defining a longitudinal axis, said open end defining at least one circumferential groove disposed substantially transverse to said longitudinal axis;

a closing lid moveable between a closed position and an open position relative to the container;

said closing lid having projections being disposed within said groove of said container to substantially fix said closing lid in the open position via continuous engagement therebetween;

and wherein said open position includes a plurality of orientations.

2. A product dispensing apparatus as recited in claim 1, further comprising a tamper indicating portion.

3. A product dispensing apparatus as recited in claim 2, wherein said tamper indicating portion includes a removable tear band.

4. A product dispensing apparatus as recited in claim 1, further comprising a retention collar for mounting said closure to the container.

5. A product dispensing apparatus as recited in claim 4, further comprising a hinge which connects said retention collar with said closing lid.

6. A product dispensing apparatus as recited in claim 5, wherein said hinge elastically connects said retention collar to said closing lid such that said hinge resiliently biases said closing lid towards the closed position.

7. A product dispensing apparatus as recited in claim 1, wherein said projections flexibly extend from said closing lid and are deflectable upon engagement with the container.

8. A product dispensing apparatus as recited in claim 1, wherein the container has an open end including a neck portion defining at least one bead disposed about at least a portion thereof.

9. A product dispensing apparatus as recited in claim 8, wherein said projections are engageable with said at least one bead.

10. A product dispensing apparatus as recited in claim 8, wherein said neck portion defines at least two beads, including a top bead and a middle bead, disposed about a circumference of said neck portion to define said groove, said projections being engageable with the container within said groove to substantially fix said closing lid in the open position.

11. A product dispensing apparatus as recited in claim 1, in the closed position, said closing lid forms a substantial seal with the container.

12. A product dispensing apparatus as recited in claim 1, in the open position, said closing lid being adjustable in the plurality of orientations.

13. A product dispensing apparatus comprising:

a container having an open end including a neck portion, said neck portion defining a circumference and a top retention bead, a middle retention bead, a lower retention bead and a transfer bead being disposed about said circumference; and a closure including a closing lid being moveable between a closed position and an open position, said closing lid having projections configured to engage at least one bead of said container, said closure further including a retention collar being mountable to said container and connectable to said closing lid such that said closing lid is biased towards said closed position;

wherein in the closed position said closing lid portion substantially seals an opening of said open end and in the open position said projections continuously engage said middle retention bead of said container to substantially fix orientation of said closing lid portion;

and wherein said open position includes a plurality of orientations.

14. A product dispensing apparatus as recited in claim 13, said projections flexibly extending from said closing lid and being deflectable upon engagement with said middle retention bead, said projections being disposable between said top bead and said middle bead to substantially fix said closing lid in the open position.

15. A product dispensing apparatus as recited in claim 13, in the closed position, said top retention bead engages a bead formed on an inner surface of said closure to facilitate formation of said substantial seal.

16. A product dispensing apparatus as recited in claim 13, in the open position, said closing lid is adjustable in the plurality of orientations.

17. A product dispensing apparatus comprising:

a container having an open end defining an opening, said container including a neck having a top retention bead, a middle retention bead, a lower retention bead and a transfer bead, said top retention bead and said middle retention bead defining a groove therebetween;

a closure including a closing lid being moveable between a first position and a second position, said closing lid having flexible projections extending therefrom configured to deflect upon engagement with said middle retention bead of said container, said closure further including a retention collar being mountable to said container and connectable to said closing lid via an elastic hinge such that said closing lid is resiliently biased towards said first position; and a tamper indicating portion including a tear band which removably connects said closing lid and said retention collar to provide a first visual indication, said tamper indicating portion being removable to provide a second visual indication;

wherein in the first position said closing lid portion substantially seals said opening of said open end and in the second position said projections continuously engage said neck of said container and are configured for disposal within at least a portion of said groove to substantially fix orientation of said closing lid portion; wherein said second position includes a plurality of orientations.

18. A closure adapted for use with a product dispensing container, the closure comprising:

a closing lid means moveable between a closed position and an open position;

a retention means for mounting the closure to the product dispensing container, said retention means being flexibly connected to said closing lid means to resiliently bias said closing lid means towards said closed position; and an engagement means including at least one groove circumferentially disposed about an open end of the product dispensing container and tabs of said closing lid means, said tabs being disposed within said groove for substantially fixing said closing lid means in said open position via continuous engagement between said closure and said product dispensing container;

wherein said open position includes a plurality of orientations.

* * * * *